United States Patent [19]

Goodlad et al.

[11] Patent Number: 4,599,035

[45] Date of Patent: Jul. 8, 1986

[54] ARTICLE RAISING AND LOWERING APPARATUS

[75] Inventors: Albert P. Goodlad, Toms River; Ralph De Stephanis, Middlesex, both of N.J.

[73] Assignee: RCA Corporation, Princeton, N.J.

[21] Appl. No.: 694,972

[22] Filed: Jan. 25, 1985

[51] Int. Cl.[4] ..... B66F 9/16

[52] U.S. Cl. ..... 414/697; 414/716; 414/742; 414/917

[58] Field of Search ..... 414/680, 697, 706, 710, 414/712, 716, 742, 917, 557, 546, 471; 254/8 R, 8 B, 9 R, 9 B; 187/8.71, 8.72, 9 R

[56] References Cited

U.S. PATENT DOCUMENTS

| | | | |
|---|---|---|---|
| 2,500,815 | 3/1950 | Gerli et al. | 414/917 X |
| 2,573,416 | 10/1951 | Eddy | 445/62 |
| 2,792,135 | 5/1957 | Wood | 414/557 |

*Primary Examiner*—Robert J. Spar
*Assistant Examiner*—D. Glenn Dayoan
*Attorney, Agent, or Firm*—E. M. Whitacre; D. H. Irlbeck; L. L. Hallacher

[57] ABSTRACT

A device for raising and lowering a heavy object between selected heights and positions includes two pairs of spaced, parallel lift arms which are pivotally coupled at one end. One end of one of the pairs of lift arms is pivotally coupled to a base member. A shaft extends between the lever arms and a handle is provided to rotate the shaft to simultaneously rotate the lift arms with respect to the base member. Linkages couple the other lift arms to the shaft at pivot points which are offset from the pivot points of the lift arms and from the shaft. Accordingly, the two pairs of lever arms simultaneously move with respect to one another upon the actuation of the connecting shaft.

7 Claims, 3 Drawing Figures

ARTICLE RAISING AND LOWERING APPARATUS

BACKGROUND

This invention relates generally to article handling apparatus and particularly to an apparatus for raising and lowering heavy articles.

Labor is a substantial portion of the production costs of many articles of manufacture. For this reason, significant effort and capital expenditures are being made to automate many manufacturihg facilities. A significant portion of the capital expenditures are directed toward equipment for eliminating mundane jobs which are boring and strenuous. An example of such a mundane job is the raising and lowering of heavy objects to preselected heights and locations. Thus, an apparatus which is capable of receiving a heavy object and raising the object to a preselected height and location would be highly advantageous in the elimination of a strenuous, manual operation and would result in substantial production cost savings. The present invention is directed to such an apparatus.

SUMMARY

An article raising and lowering apparatus includes a multisided base member having two spaced and substantially parallel sides. First lift arms have one end individually, and pivotally coupled to the sides. Second lift arms are individually, pivotably coupled to the free end of the first lift arms. First moving means simultaneously and bilaterally moves the first, and second lift arms between raised and lowered positions. Second moving means simultaneously and bilaterally moves the second arms between the raised position and an intermediate position. Article carrier members are arranged on the second lift arms whereby an article placed on the carrier members is bilaterally movable between all of the positions.

DETAILED DESCRIPTION

Figure 1:
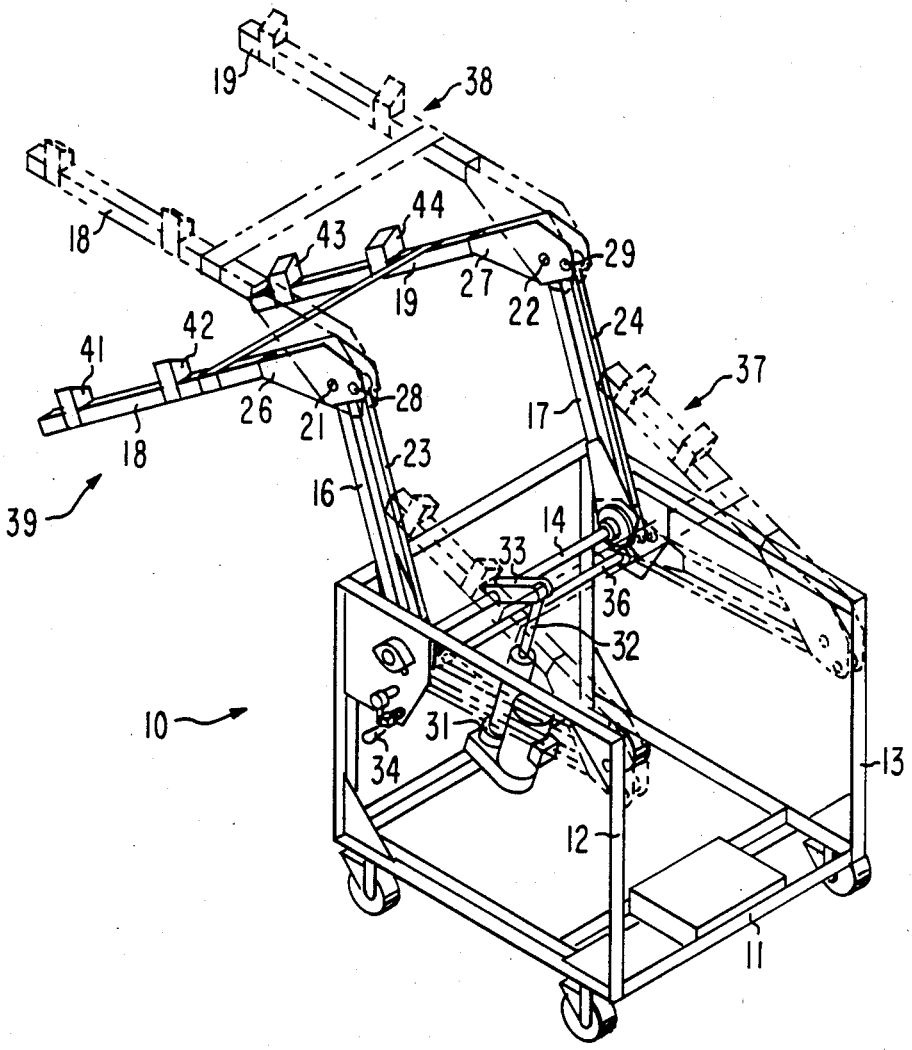
FIG. 1 is a isometric view of a preferred embodiment.

In FIG. 1, the article raising and lowering apparatus 10, includes a multisided base member 11 having spaced, parallel sides 12 and 13. A shaft 14 is rotatively supported by the sides 12 and 13. First lift arms 16 and 17 are fixed to the ends of the shaft 14. Accordingly, rotation of the shaft 14 causes the lift arms 16 and 17 to simultaneously pivot with respect to the sides 12 and 13. Second lift arms 18 and 19 are pivotally coupled to the free ends of the first lift arms 16 and 17, respectively, at the pivot points 21 and 22. Actuating linkages 23 and 24 are coupled at one end to the lift arms 18 and 19, respectively, by brackets 26 and 27. The linkages 23 and 24 are coupled to the brackets 26 and 27 at pivot points 28 and 29, which are offset from the pivot points 21 and 22. The other end of the linkages 23 and 24 are pivotably coupled to the sides 12 and 13, respectively, in a manner described hereinafter. Rotation of the shaft 14 activates the linkages 23 and 24 to cause the arms 18 and 19 to pivot with respect to the lift arms 16 and 17 simultaneously with the motion of the lift arms 16 and 17. A cylinder 31 has a longitudinally movable shaft 32 connected to the shaft 14 by a lever 33, which is affixed to the shaft 14. Accordingly, linear motion of the shaft 32 results in rotation of the shaft 14 and the simultaneous rotation of the arms 16, 17, 18 and 19. A crank handle 34 is fixed to a shaft 36 and is used to actuate the linkages 23 and 24 to move the arms 18 and 19 about the pivot points 21 and 22. The arms 16, 17, 18 and 19 are pivoted from a lower or folded, position 37 to a fully raised position 38 by rotation of the shaft 14. The lift arms 18 and 19 also are pivotal to an intermediate position 39 by use of the crank handle 34 in a manner fully described hereinafter with respect to FIGS. 2 and 3. Article carrying members 41 and 42 are provided on the lift arm 18. Similar article carrying members 43 and 44 are provided on the lift arm 19. The spacing between the article carrying members on the individual arms and the spacing between the arms 18 and 19 are selected in accordance with the approximate size of the article to be carried. Thus, when the article to be lifted is a kinescope for a color television receiver, the article carrying members 41 and 42 and the lift arms 18 and 19 are spaced so that several sizes of kinescopes can be raised by the device 10.

Figure 2:
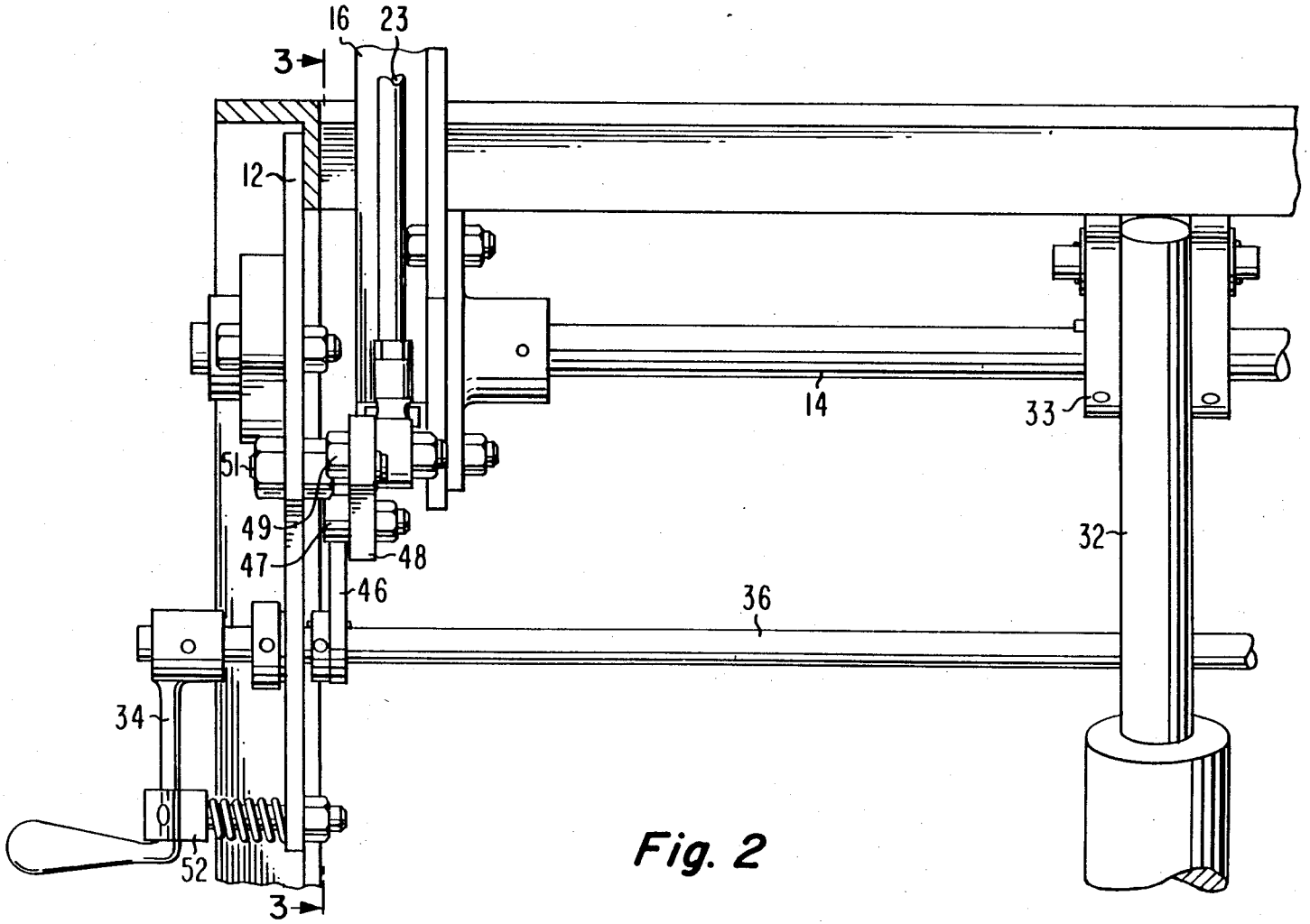
FIG. 2 is a more detailed showing of a portion of the preferred embodiment of FIG. 1 looking toward the left in FIG. 1.
Figure 3:
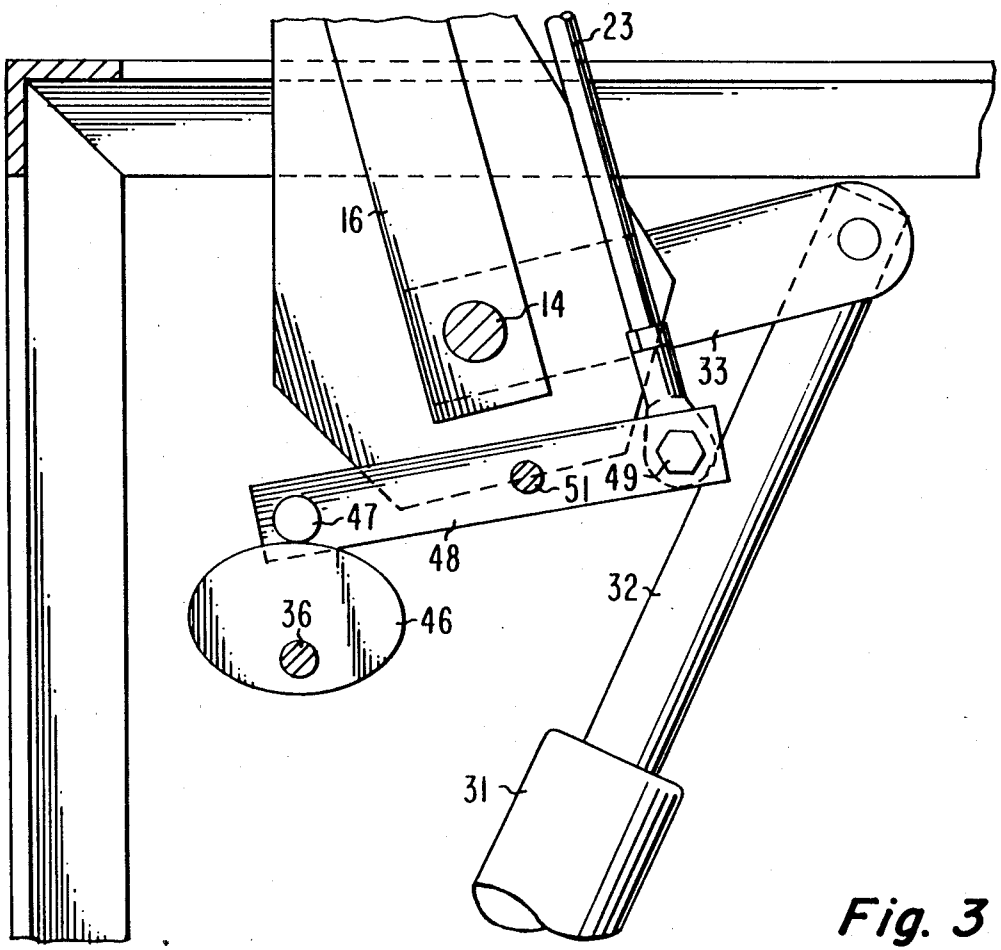
FIG. 3 is a cross section taken along line 3—3 of FIG. 2.

FIGS. 2 and 3 show in detail the arrangement of the shafts 14 and 36 with respect to the side 12 of the device. A similar arrangement couples the other ends (not shown) of the shafts 14 and 36 to the other side 13 of the device 10. In FIGS. 2 and 3, a cam 46 is permanently affixed to the shaft 36. A cam follower 47 rides on the edge of the cam to follow the contour of the cam. The cam follower 47 is attached to a connecting link 48. The other end of the connecting link 48 is pivotally attached to the actuating linkage 23 at a pivot point 49. The connecting link 48 is pivotally coupled to the side 12 of the base 11 at a pivot point 51.

In operation, initially the shaft 32 is fully drawn into the cylinder 31 and the shaft 14 is rotated to the full clockwise position. The lift arms 16, 17, 18 and 19 are in the lowermost, or folded, position 37 shown in FIG. 1. The cylinder 31 can be either hydraulic or pneumatic, and upon actuation the shaft 32 moves outwardly rotating the shaft 14 counterclockwise. The lift arms 16 and 17 are fixed to the shaft 14 and, therefore, also move counterclockwise toward the upper position 38. The other lever arms 18 and 19 are pivotably coupled to the moving ends of the lift arms 16 and 17 by the brackets 26 and 27, respectively, and therefore also rotate upwardly. The actuation lever 23 has fixed length. Also, the pivot point 49 is offset from the shaft 14 and the pivot point 28 is offset from the pivot point 21. Accordingly, rotation of the lift arm 16 also rotates the lift arm 18. The lift arm 19 is similarly coupled to the lift arm 17 and the actuating linkage 24 pivot points are offset from those of the arms 19 and 17. Accordingly, the arm 19 rotates in unison with the arm 18. Because the pivot points 28 and 49 of the actuation lever 23 are displaced from the pivot point 21 and the shaft 14, respectively; and because the actuating lever 23 is shorter than the lift arm 16, the rotation of the shaft 14 causes the arm 18 to rotate away from the arm 16. The lift arm 19 also rotates away from the lift arm 17. Accordingly, when the shaft 32 is fully extended from the cylinder 31, the lift arm pairs 16-17 and 17-19 are in the upper position 38 (FIG. 1). The lift arm pair 18-19 can be raised and lowered between the raised position 38 and the intermediate position 39 by rotating the shaft 36 with the crank arms 34. The cam 46 rotates with the shaft 36 causing the cam follower 47 to follow the contour of the cams. The connecting link 48 rotates about pivot point 51 to raise and lower the pivot point 49. As pivot point raises and lowers the arms 18 and 29 pivot about the pivot points 21 and 22. A detent 52 can be provided to limit rotation of the shaft 36.

The article raising and lowering apparatus 10 can be incorporated in an automatic processing system. In such a use, the cylinder 31 and the crank 34 can be automatically actuated at the desired times. Also, the apparatus 10 can be moved between desired preselected locations by automatic equipment. The apparatus can be positioned at one location to receive an article and then moved to another location to raise, or lower, the article to a desired height.

What is claimed is:

1. An article raising and lowering apparatus comprising:

a multisided base member, two of said sides being facing and substantially parallel;

first lift arms each having one end individually, pivotally coupled to said facing sides in the proximity of an upper corner of said facing sides;

a first shaft extending between said first lift arms, said first lift arms being affixed to said first shaft, and said first moving means being coupled to said first shaft;

second lift arms individually, pivotably coupled to the free end of said first lift arms;

first moving means for simultaneously and bilaterally moving said first and second lift arms between raised and lowered positions whereby said first lift arms are substantially parallel to the tops of said facing sides, and said second lift arms are in the proximity of the tops of said facing sides when said apparatus is in said lowered position and said first moving means rotates said first shaft to effect motion of said lift arms between said raised and lowered positions;

second moving means for simultaneously and bilaterally moving said second arms between said raised position and an intermediate position; said first motion means being pivotally coupled to a lever attached to said first shaft;

said second moving means including a second shaft, a plurality of cams affixed to said second shaft, a plurality of actuating linkages individually coupled between said cams and said second lift arms, and means for rotating said second shaft to move said second arms between said raised and intermediate positions; and article carrier members arranged on said second lift arms whereby an article placed on said carrier members is bilaterally movable between all of said positions.

2. The apparatus of claim 1 further including connecting links pivotably coupled to each of said facing sides, cam followers in the proximity of one end said connecting links and riding on said cams, said actuating linkages being individually and pivotably coupled to said connecting links whereby rotation of said second shaft rotates said cams to pivot said connecting links and move said second arms between said raised and said intermediate positions.

3. The apparatus of claim 2 further including means for limiting rotation of said second shaft whereby motion between said raised and lowered positions is limited.

4. The apparatus of claim 3 wherein said actuating linkages are individually pivotably coupled to said second lift arms at pivot points displaced from the pivot points between said first and second lift arms.

5. An article raising and lowering apparatus comprising:

a first pair of lift arms affixed in a parallel, spaced relationship;

a second pair of lift arms affixed in a parallel, spaced relationship, one end of said second lift arms being pivotably coupled to one end of said first lift arms whereby said pairs of arms are normally in a closed, folded position and are pivotable to an open position;

a base member, the other ends of said first pair of arms being pivotably coupled to said base member, said pairs of arms being in the proximity of said base member when in said folded position; and means for moving said pairs of arms between said folded and said open positions, said means for moving including first and second moving means, said second moving means including a shaft, a plurality of actuating linkages individually coupled between said cams and said second lift arms, and means for rotating said shaft to move said second arms between said folded and open positions.

6. The apparatus of claim 5 further including connectig links individually pivotably coupled to each of said facing sides, a cam links follower in the proximity of one end of each of said connecting links and riding on said cams, said actuating linkages being individually and pivotably coupled to said connecting links whereby rotation of said second shaft rotates said cams to pivot said connecting links and move said second arms between said raised and said intermediate positions.

7. The apparatus of claim 6 wherein said actuating linkages are individually pivotably coupled to said second lift arms at pivot points displaced from the pivot points between said first and second lift arms.

* * * * *